US007980239B1

(12) United States Patent
Parmer, Sr.

(10) Patent No.: US 7,980,239 B1
(45) Date of Patent: Jul. 19, 2011

(54) BOW AND ARROW HOLDER COMBINATION

(76) Inventor: Doral T. Parmer, Sr., Ste. Genevieve, MO (US)

( * ) Notice: Subject to any disclaimer, the term of this patent is extended or adjusted under 35 U.S.C. 154(b) by 521 days.

(21) Appl. No.: 12/117,210

(22) Filed: May 8, 2008

(51) Int. Cl.
*F41B 5/00* (2006.01)
*F41B 5/06* (2006.01)

(52) U.S. Cl. ..... 124/86; 124/25.7

(58) Field of Classification Search ..... 124/23.1, 124/25.5, 25.6, 25.7, 86; 224/916
See application file for complete search history.

(56) References Cited

U.S. PATENT DOCUMENTS

| | | | | | |
|---|---|---|---|---|---|
| 2,464,068 | A | | 3/1949 | Bear | |
| 2,954,764 | A | * | 10/1960 | Stinson | 124/25.7 |
| 2,999,620 | A | * | 9/1961 | Haggard | 124/88 |
| 3,108,725 | A | | 10/1963 | Ramsey | |
| 3,114,485 | A | * | 12/1963 | Whiffen | 124/88 |
| 3,116,730 | A | | 1/1964 | Tingley | |
| 3,366,101 | A | * | 1/1968 | Saunders | 124/88 |
| 3,561,651 | A | * | 2/1971 | Ramsey | 124/88 |
| 3,591,062 | A | * | 7/1971 | Karbo | 124/88 |
| 3,595,214 | A | * | 7/1971 | O'Malley et al. | 124/25.7 |
| 3,716,174 | A | * | 2/1973 | Ehlert | 124/88 |
| 3,777,734 | A | | 12/1973 | Rose | |
| 3,946,718 | A | * | 3/1976 | Garman | 124/86 |
| 4,020,984 | A | | 5/1977 | Morris | |
| 4,195,616 | A | | 4/1980 | Darlington | |
| 4,621,606 | A | | 11/1986 | Toth | |
| 5,107,819 | A | | 4/1992 | Pugh | |
| 2003/0140913 | A1 | | 7/2003 | Stinson | |

* cited by examiner

*Primary Examiner* — John Ricci

(57) ABSTRACT

A bow and arrow holder combination includes a bow that includes a grip, an upper limb, a lower limb and a bowstring extending between the upper and lower limbs. The upper and lower limbs each have a first side and a second side. An upper coupler is mounted to the upper limb and extends outwardly from the first side of the upper limb. The upper coupler releasably engages an arrow. A lower coupler is mounted to the lower limb and extends outwardly from the first side of the lower limb. The lower coupler releasably engages the arrow.

5 Claims, 5 Drawing Sheets

BOW AND ARROW HOLDER COMBINATION

BACKGROUND OF THE INVENTION

Field of the Invention

The present invention relates to arrow holding devices and more particularly pertains to a new arrow holding device for holding an arrow on a bow for easy and efficient accessibility to the arrow.

SUMMARY OF THE INVENTION

The present invention meets the needs presented above by generally comprising a bow that includes a grip, an upper limb, a lower limb and a bowstring extending between the upper and lower limbs. The upper and lower limbs each have a first side and a second side. An upper coupler is mounted to the upper limb and extends outwardly from the first side of the upper limb. The upper coupler releasably engages an arrow. A lower coupler is mounted to the lower limb and extends outwardly from the first side of the lower limb. The lower coupler releasably engages the arrow.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
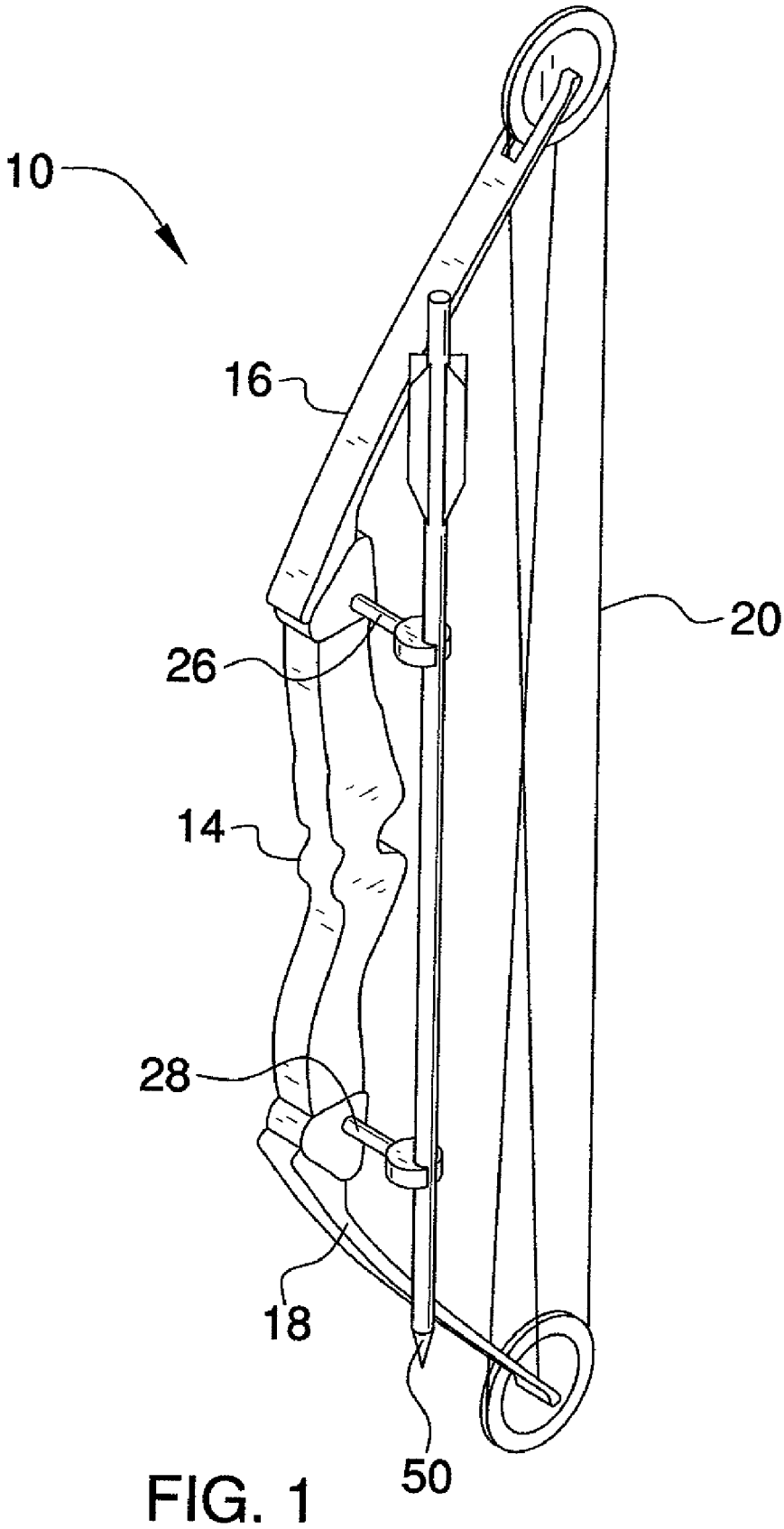
FIG. 1 is a front perspective view of a bow and arrow holder combination according to the present invention.
Figure 2:
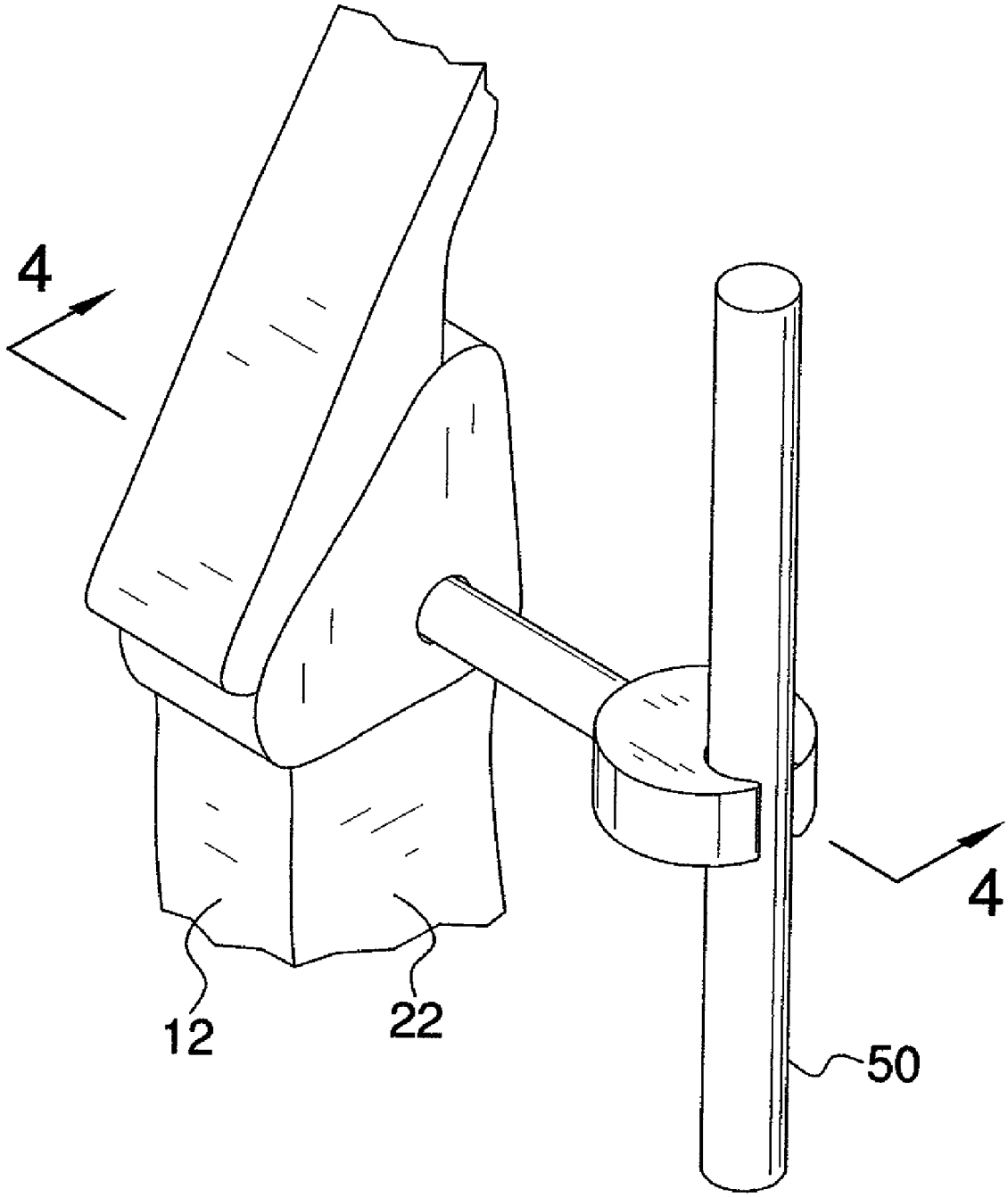
FIG. 2 is a broken perspective view of a portion of a bow and the coupler of the present invention.
Figure 3:
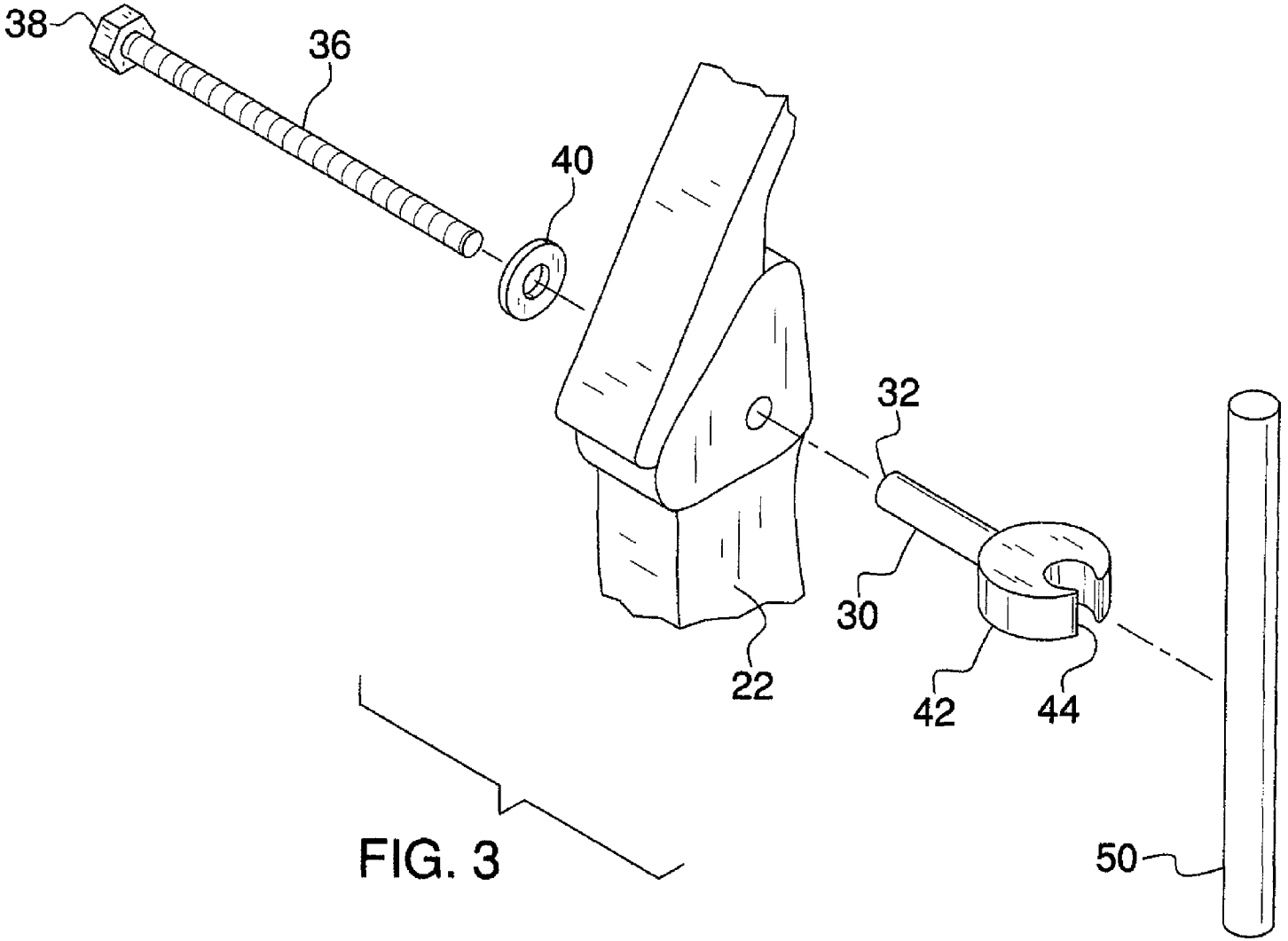
FIG. 3 is an expanded perspective view of a portion of the bow and the coupler of the present invention.
Figure 4:
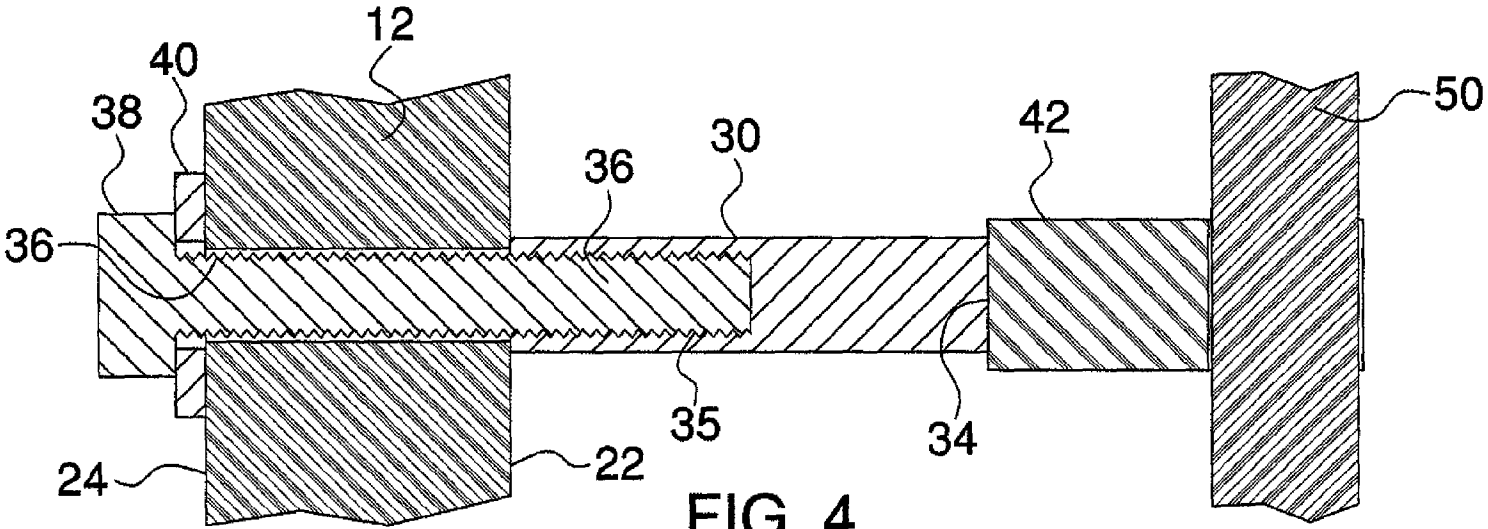
FIG. 4 is a cross-sectional view taken along line 4-4 of FIG. 2 of the present invention.
Figure 5:
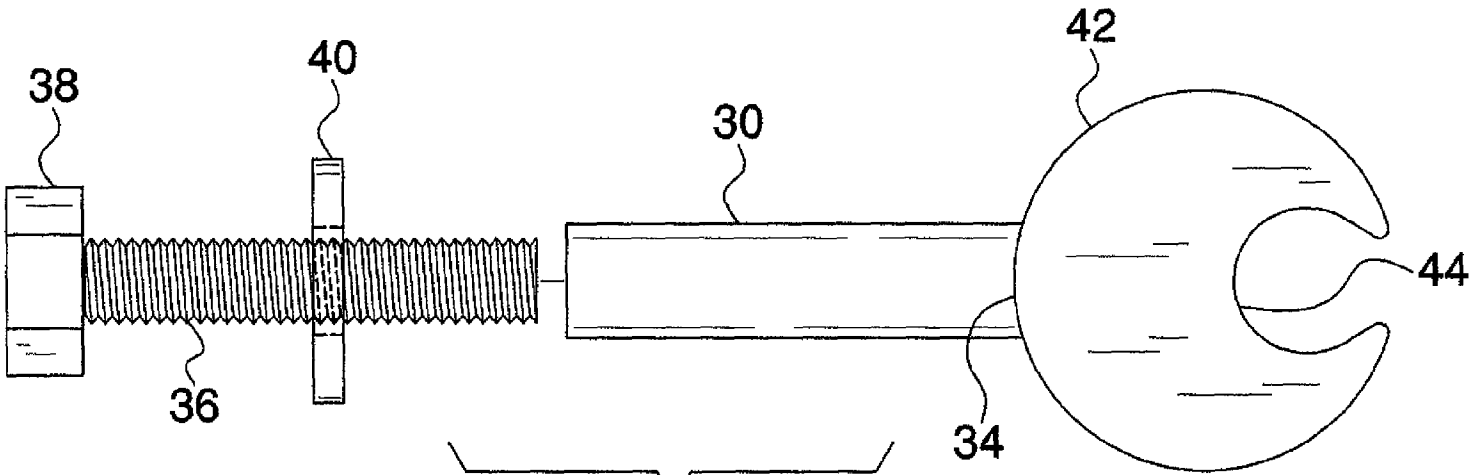
FIG. 5 is a top view of the coupler of the present invention.
Figure 6:
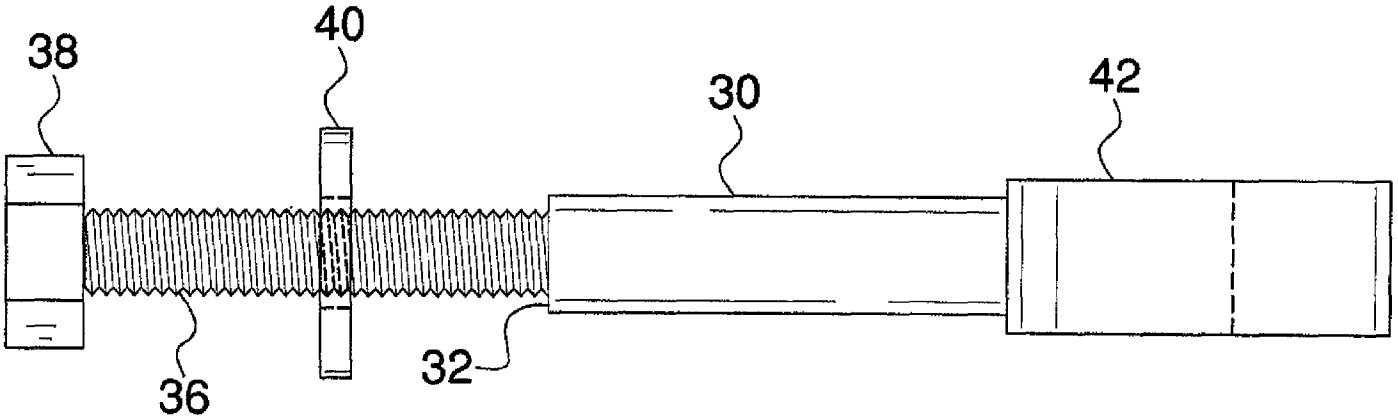
FIG. 6 is a front view of the coupler of the present invention.
Figure 7:
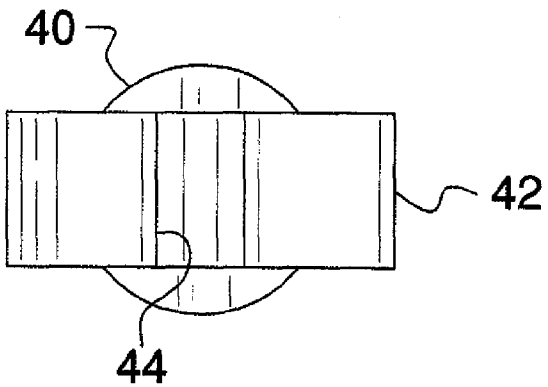
FIG. 7 is a side view of the coupler of the present invention.

With reference now to the drawings, and in particular to FIGS. 1 through 7 thereof, a new arrow holding device embodying the principles and concepts of the present invention and generally designated by the reference numeral 10 will be described.

As best illustrated in FIGS. 1 through 7, the bow and arrow holder combination 10 generally comprises a conventional bow 12 that includes a grip 14, an upper limb 16, a lower limb 18 and a bowstring 20 extending between the upper 16 and lower 18 limbs. The upper 16 and lower 18 limbs each have a first side 22 and a second side 24.

An upper coupler 26 is mounted to the upper limb 16 and extends outwardly from the first side 22 of the upper limb 16. The upper coupler 26 releasably engages an arrow 50 to vertically orient the arrow 50 when the bow 12 is vertically oriented. A lower coupler 28 is mounted to the lower limb 18 and extends outwardly from the first side 22 of the lower limb 18. The lower coupler 28 also releasably engages the arrow 50.

Each of the upper 26 and lower 28 couplers includes a rod 30 that has a first end 32 and a second end 34. The first end 32 of the rod has a threaded well 34 extending therein. The rod 30 of the upper coupler 26 has its first end 32 abutting the first side 22 of the upper limb 16. The rod 30 of the lower coupler 28 has its first end 32 abutting the first side 22 of the lower limb 18. A fastener 36 is threaded and extending through the second side and into the threaded well 34 of a respective one of the rods 30. The fasteners 36, of the upper 26 and lower 28 couplers, have a head 38 abutting a second side of an associated one of the upper 16 and lower 18 limbs. The fastener 36 comprised a bolt. A washer 40 may be positioned between the fastener 36 and the bow 12. A saddle 42 for receiving the arrow 50 is attached to the second end 34 of the rod 30. The saddle 42 has a notch 44 therein to receive the arrow 50 and frictionally engages the arrow 50 to releasably secure the arrow 50 to the bow 12. The saddle 42 is comprised of an elastomeric material. The notch 44 is directed away from the bow 12 to position the arrow 50 in an easy to grip location.

In use, the user of the bow 12 will use it in a conventional manner and when hunting, an extra arrow 50 is placed in the upper 26 and lower 28 couplers so that the extra arrow 50 is quickly accessible when needed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An arrow holding combination comprising:

a bow including a grip, an upper limb, a lower limb and a bowstring extending between said upper and lower limbs, said upper and lower limbs each having a first side and a second side;

an upper coupler being mounted to said upper limb and extending outwardly from said first side of said upper limb, said upper coupler releasably engaging an arrow a lower coupler being mounted to said lower limb and extending outwardly from said first side of said lower limb, said lower coupler releasably engaging the arrow, each of said upper and lower couplers including:

a rod having a first end and a second end, said first end having a threaded well extending therein, said first end of said rod of said upper coupler abutting said first side of said upper limb, said first end of said rod of said lower coupler abutting said first side of said lower limb;

a fastener being threaded and extending into said second side of said bow and outwardly of said first side of said bow and into said threaded well, said fastener having a head abutted against said second side of an associated one of said upper and lower limbs; and a saddle for receiving the arrow being attached to said second end of said rod, said saddle having a notch therein to receive the arrow.

2. The combination according to claim 1, wherein said saddle frictionally engages the arrow to releasably secure the arrow to the bow.

3. The combination according to claim 2, wherein said saddle is comprised of an elastomeric material.

4. The combination according to claim 1, wherein said notch is directed away from said bow.

5. An arrow holding combination comprising:

a bow including a grip, an upper limb, a lower limb and a bowstring extending between said upper and lower limbs, said upper and lower limbs each having a first side and a second side;

an upper coupler being mounted to said upper limb and extending outwardly from said first side of said upper limb, said upper coupler releasably engaging an arrow;

a lower coupler being mounted to said lower limb and extending outwardly from said first side of said lower limb, said lower coupler releasably engaging the arrow;

each of said upper and lower couplers including;

a rod having a first end and a second end, said first end having a threaded well extending therein, said first end of said rod of said upper coupler abutting said first side of said upper limb, said first end of said rod of said lower coupler abutting said first side of said lower limb;

a fastener being threaded and extending into said second side of said bow and outwardly of said first side of said bow and into said threaded well, said fastener having a head abutted against said second side of an associated one of said upper and lower limbs; and a saddle for receiving the arrow being attached to said second end of said rod, said saddle having a notch therein to receive the arrow, said saddle frictionally engaging the arrow to releasably secure the arrow to the bow, said saddle being comprised of an elastomeric material, said notch being directed away from said bow.

* * * * *